United States Patent [19]

Borst

[11] Patent Number: 5,045,001

[45] Date of Patent: Sep. 3, 1991

[54] AUXILIARY AUTOMATIC COOLING WATER SUPPLY FOR MARINE ENGINES

[75] Inventor: Gaylord M. Borst, Gurnee, Ill.

[73] Assignee: Outboard Marine Corporation, Waukegan, Ill.

[21] Appl. No.: 492,094

[22] Filed: Mar. 12, 1990

[51] Int. Cl.[5] ..... B63H 21/38

[52] U.S. Cl. ..... 440/1; 440/88; 123/41.02; 123/41.15

[58] Field of Search ..... 440/1, 2, 88, 900; 123/41.02, 41.05, 41.08, 41.15, 41.29, 41.44

[56] References Cited

U.S. PATENT DOCUMENTS

| | | | |
|---|---|---|---|
| 2,350,598 | 6/1944 | Faville . | |
| 2,953,125 | 9/1960 | Garcia . | |
| 3,137,281 | 6/1964 | Fulker . | |
| 3,323,502 | 6/1967 | Whalen . | |
| 3,908,579 | 9/1975 | Miller et al. . | |
| 4,019,489 | 4/1977 | Cartmill | 123/41.15 |
| 4,061,187 | 12/1977 | Rajasekaran et al. . | |
| 4,075,969 | 2/1978 | Griffin | 440/88 |
| 4,117,822 | 10/1978 | Mills | 123/41.15 |
| 4,147,151 | 4/1979 | Wright | 123/41.15 |
| 4,728,306 | 3/1988 | Schneider . | |
| 4,759,316 | 7/1988 | Itakura | 123/41.29 |
| 4,789,367 | 12/1988 | Fulks . | |

*Primary Examiner*—Sherman Basinger
*Assistant Examiner*—Stephen P. Avila
*Attorney, Agent, or Firm*—Michael, Best & Friedrich

[57] ABSTRACT

A marine propulsion device comprising an internal combustion engine, primary structure for supplying cooling water to the engine, and ancillary structure for supplying cooling water to the engine in response to the temperature of the engine exceeding a predetermined temperature and for continuing to supply cooling water to the engine until the ancillary structure is manually deactivated.

24 Claims, 2 Drawing Sheets

AUXILIARY AUTOMATIC COOLING WATER SUPPLY FOR MARINE ENGINES

BACKGROUND OF THE INVENTION

The invention relates generally to water cooling systems for internal combustion engines, and more particularly to water cooling systems for internal combustion engines in marine propulsion devices.

In the operation of boat mounted, water cooled marine engines, there are occasions where the inlet to the water pump of the engine may become plugged by debris, resulting in engine overheating.

It is known to provide auxiliary water pumps for cooling internal combustion engines in marine propulsion devices. In Schneider U.S. Pat. No. 4,728,306, col. 2, lines 50–54, an embodiment is described wherein an auxiliary water pump is activated whenever engine temperature exceeds a given value regardless of whether the engine is on or off.

Fulker U.S. Pat. No. 3,137,281 relates to a boat engine cooling system that includes, in one embodiment, an auxiliary water pump which is turned on automatically after the engine is turned off, and which turns off when a thermostat or thermocouple indicates that engine temperature has fallen below a selected temperature.

Attention is also directed to the following U.S. Pat. Nos. which relate generally to cooling or pumping systems in internal combustion engines or boats:

| Inventor | U.S. Pat. No. | Issue Date |
|---|---|---|
| Faville | 2,350,598 | June 6, 1944 |
| Garcia | 2,953,125 | September 20, 1960 |
| Wahlen | 3,323,502 | June 6, 1967 |
| Miller et al. | 3,908,579 | September 30, 1975 |
| Rajasekaran et al. | 4,061,187 | December 6, 1977 |
| Fulks | 4,789,367 | December 6, 1988 |

SUMMARY OF THE INVENTION

The invention provides a marine propulsion device comprising an internal combustion engine, primary means for supplying cooling water to the engine, and ancillary means for supplying cooling water to the engine in response &o the temperature of the engine exceeding a predetermined temperature and for continuing to supply cooling water to the engine until the ancillary means is manually deactivated.

One embodiment of the invention provides a marine propulsion device comprising an internal combustion engine, primary means for supplying cooling water to the engine, means for sensing the temperature of the engine, selectively actuatable auxiliary means for supplying cooling water to the engine, a user actuatable actuator, control means for actuating the auxiliary water supplying means in response to the temperature sensing means sensing a temperature in excess of a predetermined temperature, and for continuing to actuate the auxiliary water supplying means, after the temperature sensing means senses a temperature below the predetermined temperature, until the actuator is actuated, and an audible alarm operable in response to the temperature sensing means sensing a temperature in excess of the predetermined temperature.

One embodiment of the invention provides an engine apparatus comprising an internal combustion engine, primary means for supplying cooling water to the engine, and ancillary means for supplying cooling water to the engine in response to the temperature of the engine exceeding a predetermined temperature and for continuing to supply cooling water to the engine until the auxiliary means is manually deactivated.

Another embodiment of the invention provides an engine apparatus for use with a battery having a positive terminal and a ground terminal, the engine apparatus comprising an internal combustion engine, primary means for supplying cooling water to the engine, temperature sensing means which is adapted to be connected to the ground terminal of the battery, which includes a terminal, and which provides a ground at the terminal thereof only in response to the temperature of the internal combustion engine exceeding a predetermined threshold temperature, electrically operable auxiliary pump means for supplying cooling water to the engine and including first and second terminals, the first terminal being adapted to be connected to ground, a switch having first and second terminals, the first terminal being adapted to be connected to the positive terminal of the battery, an SCR having a gate, an anode connected to the second terminal of the switch, and a cathode connected to the second terminal of the auxiliary pump means, a PNP transistor having a base, an emitter adapted to be connected to the positive terminal of the battery, and a collector connected to the gate of the SCR, biasing means for normally maintaining the transistor in a non-conductive state, the biasing means including a first resistor having an end connected to the base and having another end adapted to be connected to the positive terminal of the battery, the biasing means further including a second resistor having an end connected to the collector of the transistor, and having another end adapted to be connected to ground, means defining a capacitance and having a first end connected to the base of the transistor and a second end connected to the terminal of the temperature sensing means, the capacitance means instantaneously overcoming the biasing means and rendering the transistor conductive by discharging in response to the temperature sensing means providing a ground at the terminal thereof, and means for charging the capacitance means prior to the temperature sensing means providing a ground at the terminal thereof, the charging means including the second resistor and a third resistor having an end connected to the terminal of the temperature sensing means and another end adapted to be connected to the positive terminal of the battery.

A primary feature of the invention is that water is supplied to an internal combustion engine by auxiliary water supplying means when a temperature sensing means senses an engine temperature in excess of a predetermined temperature, until a user actuable actuator is actuated. Thus, the auxiliary water supplying means will not shut off until the operator or a repair person actuates the user actuable actuator after being able to correct the problem that caused the engine temperature to rise above the predetermined temperature.

Another primary feature of the invention is that, in a marine propulsion device adapted to be mounted on a boat operable on a body of water and including an internal combustion engine, primary means including a water inlet is provided for supplying cooling water from the body of water to the internal combustion engine, and ancillary means including a water inlet is provided for supplying cooling water from the body of water to the internal combustion engine, wherein the inlet of the ancillary means is spaced from the inlet of the primary means.

Other features and advantages of the invention will become apparent to those skilled in the art upon review of the following detailed description, claims and drawings.

Figure 1:
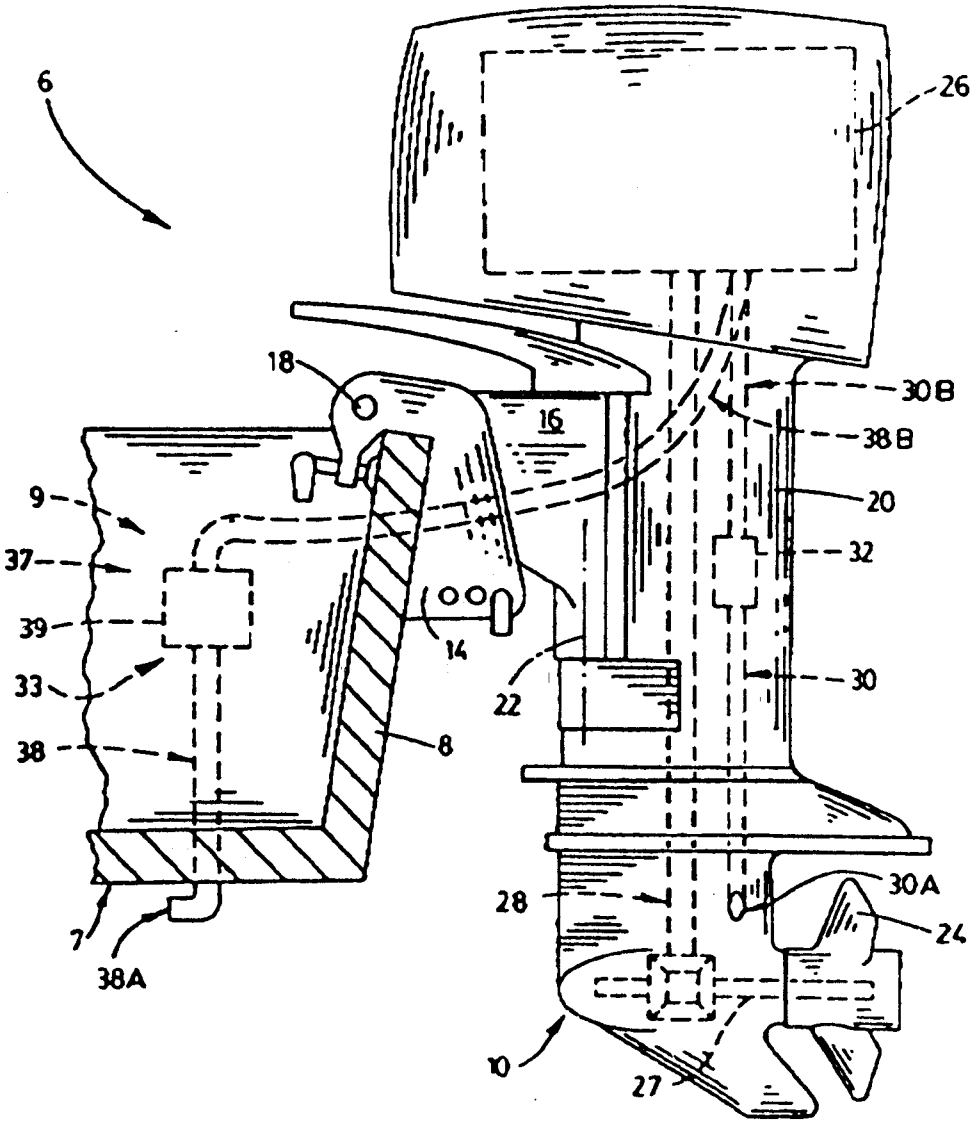
FIG. 1 is a side elevational view of a marine propulsion device embodying the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and shall not be regarded as limiting.

DESCRIPTION OF THE PREFERRED EMBODIMENT

Figure 2:
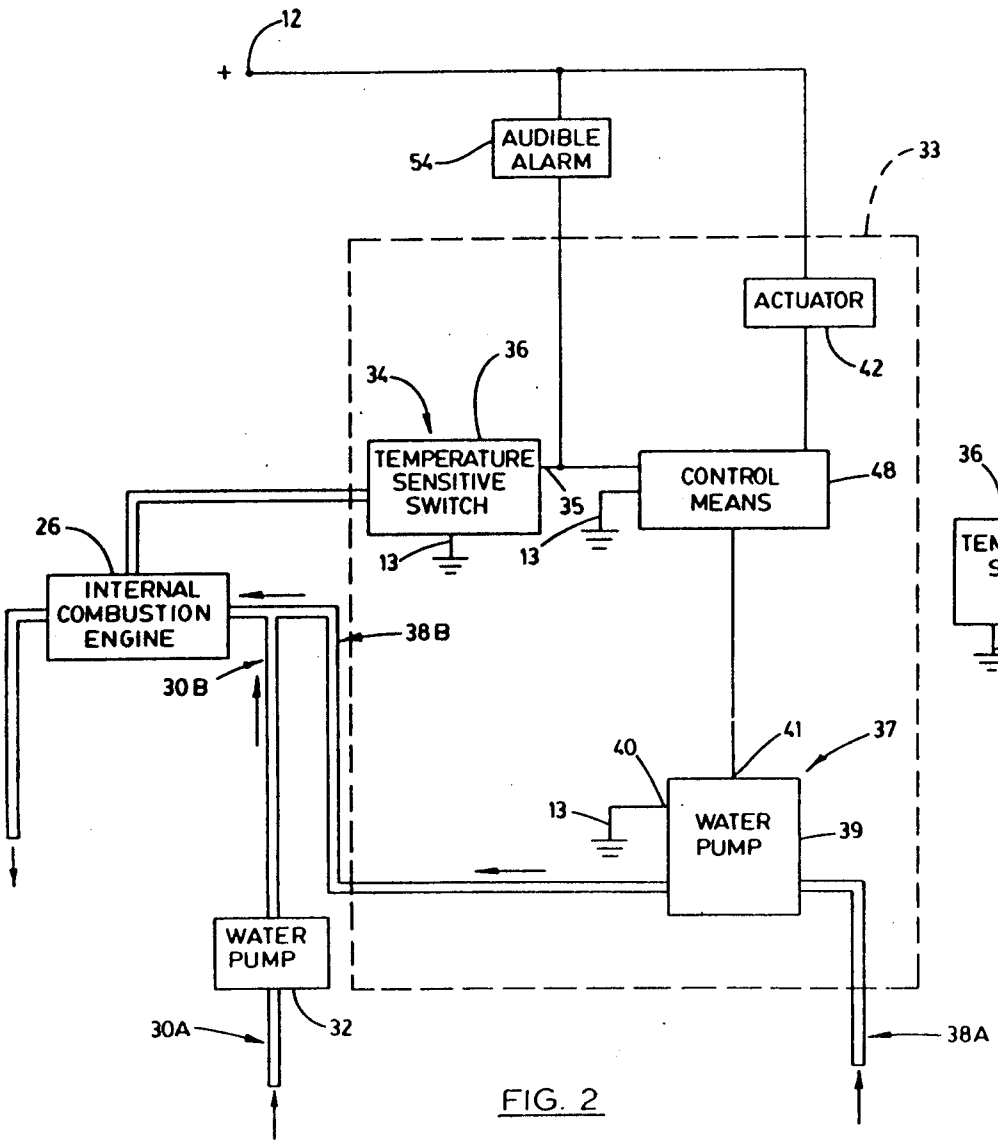
FIG. 2 is a block diagram showing electrical and fluid connections in the marine propulsion device of FIG. 1.

Shown in FIG. 1 is an apparatus 6 embodying the invention. The apparatus 6 comprises a boat 7 having a transom 8 and sides 9. The apparatus 6 further includes a marine propulsion device 10 mounted on the transom 8 of &he boat 7 and adapted to be used with a battery having a positive terminal 12 and a ground terminal 13 (see FIGS. 2 and 3). As shown in FIG. 1, the marine propulsion device 10 comprises a mounting assembly mounted on the transom 8 of the boat 7. While various suitable mounting assemblies can be used, in the illustrated construction the mounting assembly includes a transom bracket 14 fixedly mounted on the transom 8, and a swivel bracket 16 mounted on the transom bracket 14 for pivotal movement relative thereto about a generally horizontal tilt axis 18.

The marine propulsion device 10 also comprises (see FIG. 1) a propulsion unit 20 mounted on the swivel bracket 16 for pivotal movement relative thereto about a generally vertical steering axis 22, and for common movement therewith about the tilt axis 18. The propulsion unit 20 includes a propeller shaft 27 supporting a propeller 24, and an internal combustion engine 26 drivingly connected to the propeller shaft by a conventional drive train 28.

The marine propulsion device 10 further comprises (see FIGS. 1 and 2) primary means for supplying cooling water to the internal combustion engine 26 from the body of water on which the boat 7 is operated. While various suitable means can be employed, in the illustrated embodiment the primary means includes a conduit 30 in the propulsion unit 20. The conduit 30 has a lower end or inlet 30A communicating with the body of water and an upper end or outlet 30B communicating with the internal combustion engine 26. The primary means also includes a water pump 32 operative to pump water through the conduit 30 from the body of water to the internal combustion engine 26. Such an arrangement is known in the art and will not be explained in greater detail.

The marine propulsion device 10 further includes (see FIGS. 1 and 2) ancillary means 33 for supplying cooling water to the engine 26 in response to the temperature of the engine 26 exceeding a predetermined temperature and for continuing to supply cooling water to the engine 26 until the ancillary means is manually deactivated. While various suitable means can be employed, in the illustrated embodiment, the ancillary means 33 includes means 34 for sensing the temperature of the engine (see FIGS. 2 and 3). While various suitable means can be employed, in the illustrated embodiment, the temperature sensing means 34 is connected to ground and comprises a terminal 35 and electronic means for sensing the temperature of cooling water supplied to the engine 26 and for providing a ground at the terminal 35 only in response to the temperature of the internal combustion engine 26 exceeding a predetermined threshold temperature. The reason for providing a ground at the terminal 35 is explained below. More particularly, in the illustrated embodiment, the temperature sensing means 34 includes a temperature sensitive switch 36.

The ancillary means 33 further includes (see FIGS. 1 and 2) selectively actuatable auxiliary means for supplying cooling water to the engine 26. While various suitable means can be employed, in the illustrated embodiment, the auxiliary means comprises water pump means 37 including a conduit 38. The conduit 38 has an inlet 38A communicating with the body of water and a outlet 38B communicating with the internal combustion engine 26. The water pump means 37 further includes an electrically operable water pump 39 (see FIGS. 1-3) operative to pump water through the conduit 38 from the body of water to the internal combustion engine 26. The water pump 39 has (see FIG. 2) a first terminal 40 and a second terminal 41. The terminal 40 is connected to ground. In the illustrated embodiment, as shown in FIG. 1, the inlet 38A of the water pump means 37 or conduit 38 is spaced from the lower end or inlet 30A of the conduit 30 to reduce the likelihood of simultaneous plugging of the inlet 38A and the inlet 30A. More particularly, in the illustrated embodiment, the water pump 39 is mounted to one of the sides 9 of the boat 7, and a portion of the conduit 38 extends downwardly from the pump 39 so that the inlet 38A is exterior of the propulsion unit 20.

The ancillary means 33 further includes (see FIGS. 2 and 3) a user actuatable actuator or switch 42 having a first terminal 44 and a second terminal 46. The first terminal 44 of the switch 42 is connected to the positive terminal 12 of the battery.

Figure 3:
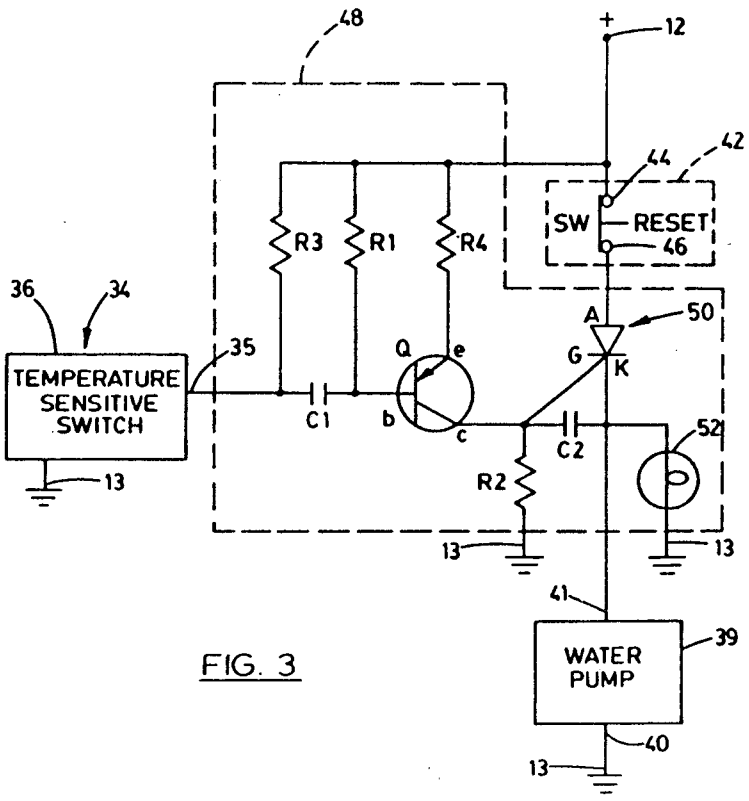
FIG. 3 is a circuit diagram of the control means of FIG. 2 and shows electrical connections to various other components shown in FIG. 2.

The ancillary means 33 further includes (see FIGS. 2 and 3) control means 48 for actuating the auxiliary water supplying means in response to the temperature sensing means 34 sensing a temperature in excess of the predetermined temperature, and for continuing to actuate the auxiliary water supplying means, after the temperature sensing means 34 senses a temperature below the predetermined temperature, until the switch 42 is actuated or opened. In the illustrated embodiment, the control means 48 comprises (see FIG. 3) a thyristor 50, which is preferably an SCR, having an anode A adapted to be connected to the positive terminal 12 of the battery, via the actuator 42, a gate G in communication with the temperature sensing means 34 as described below, and a cathode K connected to the second terminal 41 of the water pump 37. As can be seen in FIG. 3, actuation or opening of the switch 42 disconnects the anode A from the positive terminal 12 of the battery.

More particularly, in the preferred embodiment, the control means 48 further includes (see FIG. 3) a PNP bipolar junction transistor Q having an emitter e connected to the positive terminal 12 of the battery, a collector c connected to the gate G of the thyristor 50, and a base b. The preferred control means 48 further includes biasing means for normally maintaining the transistor Q in a non-conductive state, the biasing means including a first resistor $R_1$ having an end connected to the base b of the transistor Q, and another end connected to the positive terminal 12 of the battery. The biasing means further includes a second resistor $R_2$ having an end connected to the collector c of the transistor Q and having another end connected to ground.

The preferred control means 48 further includes (see FIG. 3) means defining a capacitance and having a first end connected to the base b of the transistor Q and a second end connected to the terminal 35 of the temperature sensing means 34, the capacitance means instantaneously overcoming the biasing means (resistors $R_1$ and $R_2$) and rendering the transistor Q conductive by discharging in response to the temperature sensing means 34 providing a ground at the terminal 35. Preferably, the capacitance means is defined by a capacitor $C_1$.

The preferred control means 48 further includes (see FIG. 3) means for charging the capacitor $C_1$ prior to the temperature sensing means providing a ground at &he terminal 35. The charging means includes the resistor $R_2$ and a third resistor $R_3$ having an end connected to the terminal 35 of the temperature sensing means and another end connected to the positive terminal 12 of the battery. The preferred control means 48 further includes a current limiting resistor $R_4$ having an end connected to the emitter e of the transistor Q and another end connected to the positive terminal 12 of the battery. The control means 48 further includes a noise limiting capacitor $C_2$ connected between the cathode K and the gate G of the thyristor 50.

The control means 48 optionally includes (see FIG. 3) electrically operable visual means connected between the cathode K of the thyristor 50 and ground 13 for providing a visual indication that the thyristor 50 is conducting current. In the illustrated embodiment, the visual means is a lamp or LED 52 (FIG. 3).

The apparatus 6 further includes, in the illustrated embodiment, an audible alarm 54 (FIG. 2) operable in response to the temperature sensing means 34 sensing a temperature in excess of the predetermined temperature.

In operation, when the temperature sensitive switch 36 senses that the temperature of the internal combustion engine 26 is in excess of a predetermined temperature due, for example, to the inlet 30A becoming plugged or to failure of the water pump 32, it will switch to provide a ground at the terminal 35. Capacitor $C_1$ will then overcome the biasing means (resistors $R_1$ and $R_2$) and will discharge through the terminal 35, thereby placing the transistor Q in a conductive state so that current flows through the resistor $R_4$ and the emitter e and collector c of the transistor Q. This causes the thyristor 50 to become gated so that current flows from the positive battery terminal 12 to ground through the switch 42 and the anode A and cathode K of the thyristor 50, and simultaneously through the water pump 39 and the lamp or LED 52. This current flow continues until the switch 42 is opened after the water pump 32 is repaired or the obstruction to the inlet 30A is removed. After current stops flowing from the anode A to the cathode K of the thyristor 50 upon opening of the switch 42, current will not flow through the thyristor 50 until it is again gated by the switch 36, as described above.

Thus, cooling water will be supplied to the internal combustion engine 26 when the water pump 32 is unable to sufficiently cool the internal combustion engine 26. When the temperature sensitive switch 36 provides the ground at the terminal 35, the audible alarm 54 will also be activated as a current path is provided from the positive battery terminal 12 to ground via the audible alarm 54 and the temperature sensitive switch 36. After the temperature sensitive switch 36 no longer provides the ground at the terminal 35, upon the water pump 39 cooling the internal combustion engine 26, the audible alarm 54 will shut off even though the water pump 39 may still be operating.

While the invention has been disclosed in conjunction with a marine propulsion device, it is to be understood that various features of the invention can be embodied in other devices having water cooled internal combustion engines.

Various of the features of the invention are set forth in the following claims.

I claim:

1. A marine propulsion device comprising an internal combustion engine, primary means for supplying cooling water to said engine, and ancillary means for supplying cooling water to said engine in response to the temperature of said engine exceeding a predetermined temperature and for continuing to supply cooling water to said engine regardless of engine temperature until said ancillary means is manually deactivated.

2. A marine propulsion device in accordance with claim 1 wherein said ancillary means includes means for sensing the temperature of said engine, selectively actuatable auxiliary means for supplying cooling water to said engine, a user actuatable actuator, and control means for actuating said auxiliary water supplying means in response to said temperature sensing means sensing a temperature in excess of said predetermined temperature, and for continuing to actuate said auxiliary water supplying means, after said temperature sensing means senses a temperature below said predetermined temperature, until said actuator is actuated.

3. A marine propulsion device in accordance with claim 2 wherein said primary means includes a water pump.

4. A marine propulsion device in accordance with claim 2 wherein said auxiliary means comprises an electrically operable water pump.

5. A marine propulsion device in accordance with claim 4 wherein said control means comprises a thyristor having a cathode, an anode adapted to be connected to a voltage source, via said actuator, and a gate in communication with said temperature sensing means, wherein said electrically actuatable water pump has a first terminal adapted to be connected to ground and a second terminal connected to said cathode, and wherein actuation of said actuator disconnects said anode from the voltage source.

6. A marine propulsion device in accordance with claim 2 wherein said temperature sensing means is adapted to be connected to ground and comprises a terminal and electronic means for sensing the temperature of cooling water supplied to said engine and for providing a ground at said terminal only in response to the temperature of said internal combustion engine exceeding a predetermined threshold temperature.

7. A marine propulsion device in accordance with claim 6 wherein said temperature sensing means includes a temperature sensitive switch.

8. A marine propulsion device in accordance with claim 2 and further comprising an audible alarm operable in response to said temperature sensing means sensing a temperature in excess of said predetermined temperature.

9. A marine propulsion device in accordance with claim 2, said control means further including means for providing a visual indication that said auxiliary water supplying means is operating.

10. A marine propulsion device in accordance with claim 1 wherein said primary means includes a water inlet, and wherein said ancilliary means includes water pump means having an inlet spaced from said inlet of said primary means.

11. A marine propulsion device comprising an internal combustion engine, primary means for supplying cooling water to said engine, means for sensing the temperature of said engine, selectively actuatable auxiliary means for supplying cooling water to said engine, a user actuatable actuator, control means for actuating said auxiliary water supplying means in response to said temperature sensing means sensing a temperature in excess of a predetermined temperature, and for continuing to actuate said auxiliary water supplying means, after said temperature sensing means senses a temperature below the predetermined temperature, until said actuator is actuated, and an audible alarm operable in response to said temperature sensing means sensing a temperature in excess of the predetermined temperature.

12. A marine propulsion device in accordance with claim 11 wherein said primary means includes a water pump.

13. A marine propulsion device in accordance with claim 11 wherein said secondary means includes an electrically operable water pump.

14. A marine propulsion device in accordance with claim 13 wherein said control means comprises a thyristor having an anode adapted to be connected to a voltage source, via said actuator, a cathode connected to said electrically operable water pump, and a gate in communication with said temperature sensing means.

15. A marine propulsion device in accordance with claim 11 wherein said temperature sensing means comprises electronic means for sensing the temperature of water flowing through said engine.

16. A marine propulsion device in accordance with claim 15 wherein said temperature sensing means comprises a temperature sensitive switch.

17. A marine propulsion device in accordance with claim 11, said control means further including means for providing a visual indication when said auxiliary water supplying means is actuated.

18. An engine apparatus comprising an internal combustion engine, primary means for supplying cooling water to said engine, and ancillary means for supplying cooling water to said engine in response to the temperature of said engine exceeding a predetermined temperature and for continuing to supply cooling water to said engine regardless of engine temperature until said auxiliary means is manually deactivated.

19. An engine apparatus in accordance with claim 18 wherein said ancillary means includes means for sensing the temperature of said engine, selectively actuatable auxiliary means for supplying cooling water to said engine, a user actuatable actuator, and control means for actuating said auxiliary water supplying means in response to said temperature sensing means sensing a temperature in excess of said predetermined temperature, and for continuing to actuate said auxiliary water supplying means, after said temperature sensing means senses a temperature below said predetermined temperature, until said actuator is actuated.

20. An engine apparatus for use with a battery having a positive terminal and a ground terminal, said engine apparatus comprising an internal combustion engine, primary means for supplying cooling water to said engine, temperature sensing means which is adapted to be connected to the ground terminal of the battery, which includes a terminal, and which provides a ground at said terminal thereof only in response to the temperature of said internal combustion engine exceeding a predetermined threshold temperature, electrically operable auxiliary pump means for supplying cooling water to said engine and including first and second terminals, said first terminal being adapted to be connected to ground, a switch having first and second terminals, said first terminal being adapted to be connected to the positive terminal of the battery, an SCR having a gate, an anode connected to said second terminal of said switch, and a cathode connected to said second terminal of said auxiliary pump means, a PNP transistor having a base, an emitter adapted to be connected to the positive terminal of the battery, and a collector connected to said gate of said SCR, biasing means for normally maintaining said transistor in a non-conductive state, said biasing means including a first resistor having an end connected to said base and having another end adapted to be connected to the positive terminal of the battery, said biasing means further including a second resistor having an end connected to said collector of said transistor and having another end adapted to be connected to ground, means defining a capacitance and having a first end connected to said base of said transistor and a second end connected to said terminal of said temperature sensing means, said capacitance means instantaneously overcoming said biasing means and rendering said transistor conductive by discharging in response to said temperature sensing means providing a ground at said terminal thereof, and means for charging said capacitance means prior to said temperature sensing means providing a ground at said terminal thereof, said charging means including said second resistor and a third resistor having an end connected to said terminal of said temperature sensing means and another end adapted to be connected to the positive terminal of the battery.

21. An apparatus in accordance with claim 20 and further including a current limiting resistor having an end connected to said emitter of said transistor and another end adapted to be connected to the positive terminal of the battery.

22. An apparatus in accordance with claim 20 and further including a noise limiting capacitor connected between said cathode and said gate of said SCR.

23. An apparatus in accordance with claim 20 and further including electrically operable means connected between said cathode of said SCR and ground for providing a visual indication that said SCR is conducting current.

24. An apparatus in accordance with claim 20 wherein said capacitance means is a capacitor.

* * * * *